US011800905B2

(12) United States Patent
McCain et al.

(10) Patent No.: US 11,800,905 B2
(45) Date of Patent: Oct. 31, 2023

(54) POST SURGICAL SUPPORT GARMENT

(71) Applicant: Create To Overcome LLC, Pittsburg, CA (US)

(72) Inventors: Aisha McCain, Pittsburg, CA (US); Annemarie Sheets, Pittsburg, CA (US)

(73) Assignee: Create To Overcome LLC, Pittsburg, CA (US)

( * ) Notice: Subject to any disclaimer, the term of this patent is extended or adjusted under 35 U.S.C. 154(b) by 35 days.

(21) Appl. No.: 17/512,946

(22) Filed: Oct. 28, 2021

(65) Prior Publication Data

US 2022/0047019 A1 Feb. 17, 2022

Related U.S. Application Data

(63) Continuation-in-part of application No. 16/260,057, filed on Jan. 28, 2019, which is a continuation-in-part (Continued)

(51) Int. Cl.

| | |
|---|---|
| ***A41D 13/12*** | (2006.01) |
| ***A41D 13/00*** | (2006.01) |
| ***A41D 27/20*** | (2006.01) |

(52) U.S. Cl.

CPC ..... *A41D 13/1245* (2013.01); *A41D 13/0012* (2013.01); *A41D 27/20* (2013.01); *A41D 2600/00* (2013.01)

(58) Field of Classification Search

CPC ..... A41D 13/1245; A41D 13/1236; A41D 13/1263; A41D 13/1281; A41D 13/12; A41D 13/1209; A41D 13/0012; A41D 13/1254; A41D 27/204; A41D 13/1272; A41D 13/129; A41D 27/207; A41D 2400/32; A41D 1/02; A41D 1/04; A41D 1/002; A41D 1/22; A41D 1/06; A41D 1/18; A41D 27/20–27/208; A41D 27/22; A61M 2209/088

(Continued)

(56) References Cited

U.S. PATENT DOCUMENTS 1,103,298 A * 7/1914 Kratz ..... A41D 27/20 2/254
RE15,647 E * 7/1923 Wood ..... A41D 27/20 2/254

(Continued)

*Primary Examiner* — Amy Vanatta
(74) *Attorney, Agent, or Firm* — Cynthia S. Lamon; Lamon Patent Services

(57) ABSTRACT

A garment having an inner side and an outer side and a fastening mechanism to fasten the garment while worn, a number of trapezoidal drain compartments spatially arranged and attached on the inner side of the garment, each trapezoidal drain compartment having a top opening sized to accept a stock drain bulb vertically therein and a closed bottom wide enough to accommodate the drain bulb rotated to a horizontal position therein, a same number of tube retention straps spatially arranged and attached on the inner side of the garment, each retention strap having a top opening and a bottom opening of a same size roughly equal to the width of the closed bottom side of the trapezoidal drain compartments, each retention strap vertically centered over, spaced above, and attached to the garment at a uniform distance above a trapezoidal drain compartment attached to the garment.

8 Claims, 12 Drawing Sheets

Related U.S. Application Data of application No. 15/726,307, filed on Oct. 5, 2017, now Pat. No. 10,188,160.

(58) Field of Classification Search
USPC ..... 2/94, 114, 249, 250, 254, 247
See application file for complete search history.

(56) References Cited

U.S. PATENT DOCUMENTS 2,129,196 A * 9/1938 Boshnack ..... A41D 27/20 2/254
2,642,576 A * 6/1953 Kotkes ..... A41D 13/0012 2/253
6,032,289 A * 3/2000 Villapiano ..... A41D 13/1245 2/102
8,821,461 B2 * 9/2014 Kovensky ..... A41D 13/1281 2/48
9,060,555 B1 * 6/2015 Harris ..... A41D 27/20
D764,145 S * 8/2016 Mathews ..... A41D 13/1245 D2/828
10,264,831 B1 * 4/2019 Hemker ..... A61F 5/03
2004/0226073 A1 * 11/2004 McCullar ..... A41D 13/1245 2/114
2007/0271672 A1 * 11/2007 Lentini ..... A41D 13/1245 2/69
2008/0282441 A1 * 11/2008 Green ..... A41D 13/1245 2/69
2010/0205720 A1 * 8/2010 Ortega Astor ..... A41D 27/20 2/247
2013/0212766 A1 * 8/2013 Matthews ..... A41B 1/08 2/69
2015/0366276 A1 * 12/2015 Kuzmanovski .... A41D 13/1281 2/247
2016/0029723 A1 * 2/2016 Neff ..... A41D 27/207 2/250
2019/0159533 A1 * 5/2019 James ..... A41D 13/1245
2021/0204620 A1 * 7/2021 Walji ..... A41D 13/0012

* cited by examiner

FRONT PERSPECTIVE VIEW OF GARMENT WITH POST OPERATIVE DRAIN COMPARTMENTS

OPENING OF GARMENT HAVING POST-OPERATIVE DRAIN COMPARTMENTS

POST-OPERATIVE DRAIN COMPARTMENT PINCHED OPEN TO RECEIVE A POST-OPERATIVE DRAIN RESERVOIR

FRONT PERSPECTIVE VIEW OF OPENING OF GARMENT HAVING POST-OPERATIVE DRAIN COMPARTMENTS WHEN WORN BY USER

FRONT PERSPECTIVE VIEW OF GARMENT HAVING POST-OPERATIVE DRAIN COMPARTMENTS WHEN WORN BY USER

FRONT PERSPECTIVE VIEW OF ADOLESCENT/PEDIATRIC GARMENT WITH POST OPERATIVE DRAIN COMPARTMENTS

POST SURGICAL SUPPORT GARMENT

CROSS-REFERENCE TO RELATED DOCUMENTS

The present application is a continuation-in-part (CIP) and claims priority to a U.S. patent application Ser. No. 16/260,057 entitled "Garments For Pediatric Patients With Post-Operative Drain Compartments" filed Jan. 28, 2019, which is a CIP of U.S. patent application Ser. No. 15/726,307 entitled "Garments Having Compartments That Support Post-Operative Drain Devices," filed Oct. 5, 2017, now U.S. Pat. No. 10,188,160 issued Jan. 29, 2019, the disclosure of which is included herein at least by reference.

BACKGROUND OF THE INVENTION

1. Field of the Invention

The present invention is in the field of medical support garments adapted to support post-operative procedures and treatment, and pertains more particularly to improvements in design and function of compartments and positional features of the garment.

2. Discussion of the State of the Art

Surgical tubes and drains are often used in treating patients as part of post-operative care. Improper treatment of post-surgical areas may result in the accumulation of air or fluid, which could lead to infection of the wounded area. To prevent the undesirable accumulation of fluid, post-operative drains are typically used to remove these fluids from the surgical area. Proper use of post-operative drain usually reduces the risk of infection and tends to minimize tissue trauma. Multiple variables have an impact on the effectiveness of these drains including: the consistency of the draining fluid, the tube diameter and length, and the amount of negative pressure from the drain. Post-operative drains can be used in various types of surgeries, including abdominal, breast, and orthopedic procedures.

One common type of post-operative drain is an active drain. Active drains use a closed drainage system with low-pressure suction devices that continuously remove fluids against gravity. The active drain is attached to a collapsible reservoir that exerts negative pressure to pull accumulated fluids from the wound bed. The collection reservoir expands as it collects drainage. One example of an active post-operative drain is shown in FIG. 1 (Prior Art). A reservoir 2 is attached to a drain 3. In this example, the reservoir 2 has a bulb shape with a capacity of approximately 100.0 cubic centimeters and the drain 3 has dimensions of approximately 7.0 mm in radius and 20.0 cm in length. In another example, the shape and capacity of the reservoir 2 and drain 3 dimensions may vary based on the need. One commercially available version of the post-operative drain as shown in FIG. 1 is a Jackson-Pratt Drain (also referred to as a "JP Drain"). The drain 3 may also be referred to as a "tube" and the reservoir 2 may also be referred to as a "bulb".

One known technique is to provide one or two compartments along a garment that attaches to or is worn by a patient. The compartments may be on the outside or inside of the garment. The patient wears or attaches the garment and then inserts the post-operative drain inside the compartment. However, numerous shortcomings exist with these conventional garments. For example, many of these garments do not provide sufficient support, versatility, or ease of use that is desirable for patients that have undergone challenging medical procedures.

The inventor is aware of a medical support garment having multiple compartments arranged strategically over a horizontal axis system bisecting the garment into multiple zones. The compartments each have sufficient volume to retain a surgical drain bulb attached to a drain or tubing inserted into the patient's wound or wounds. The pattern of multiple compartments is placed on the inside of two sides of the front of the garment such that the likelihood that a retention compartment is situated near and just below a draining wound opening is increased. Moreover, the larger number of compartments facilitates patients whose post-operative drain requirements include multiple drains over a larger footprint area of surgery.

Still improvements are desired to overcome deficiencies like the compartments being loosely formed over the drainage bulbs and lack of retention features for drain tubes connecting to the drainage bulbs. Therefore, what is clearly needed is a pocket design and tube retention feature that holds the drain bulbs more securely within each compartment and prevents the drainage tubes from shifting position ad chaffing the skin of a patient.

BRIEF SUMMARY OF THE INVENTION

A garment adapted for surgical wound draining support has an inner side and an outer side and a fastening mechanism to fasten the garment while worn, a number of trapezoidal drain compartments spatially arranged and attached on the inner side of the garment, each trapezoidal drain compartment having a top opening sized to accept a stock drain bulb vertically therein and a closed bottom wide enough to accommodate the drain bulb rotated to a horizontal position therein, a same number of tube retention straps spatially arranged and attached on the inner side of the garment, each retention strap having a top opening and a bottom opening of a same size roughly equal to the width of the closed bottom side of the trapezoidal drain compartments, each retention strap vertically centered over, spaced above, and attached to the garment at a uniform distance above a trapezoidal drain compartment attached to the garment.

In one embodiment, the garment is worn about the torso. In one embodiment, the drain compartments and tube retention straps are sewn into the fabric of the garment. In a preferred embodiment, the opening of the drain compartment is larger than the outside diameter of a full drain bulb and significantly smaller than the length of the drain bulb. In one embodiment, the trapezoidal drain compartments and the tube retention straps are fabricated from a polyurethane material having elastic and waterproof characteristics.

In one embodiment, the angular offset of the trapezoidal form from rectangular form is 10 degrees inward from vertical for each side of the trapezoid. In one embodiment, the garment has eight trapezoidal drain compartment and retention strap configurations arranged symmetrically at four configurations per side of the garment. In this embodiment, the individual trapezoidal drain compartment and retention strap configurations are disposed over the inner surface of the garment according to a set of vertical and horizontal axis'.

According to an embodiment of the present invention, a method is provided for inserting a drain bulb adapted for collecting fluids draining from a surgical wound through a connected drainage tube into a trapezoidal drain compartment attached to the inner side of a garment through a tube retention strap attached to the inner side of the garment above the drain compartment including the steps (a) insert the drain bulb under the retention strap, (b) insert the drain bulb in vertical orientation into the opening of the trapezoidal drain compartment, (c) urge the drain bulb toward the bottom of the trapezoidal drain compartment while rotating the bulb into a horizontal position, and (d) inserting any extra length of tubing connected to the drain bulb into the opening of the trapezoidal drain compartment.

In one aspect of the method, the garment is worn about the torso. In one aspect, in (a) the retention strap is disposed directly above the trapezoidal drain compartment. In a preferred aspect in (b) the opening of the trapezoidal drain compartment is larger than the outside diameter of a full drain bulb and significantly smaller than the length of the drain bulb. Also in a preferred aspect, in (c) the bottom width of the trapezoidal drain compartment is greater than the length of the drain bulb. In one aspect of the method, the drain bulb is a stock Jackson-Pratt (JP) drain bulb of 100 cc fluid retention capacity.

DETAILED DESCRIPTION OF THE INVENTION

Figure 1:
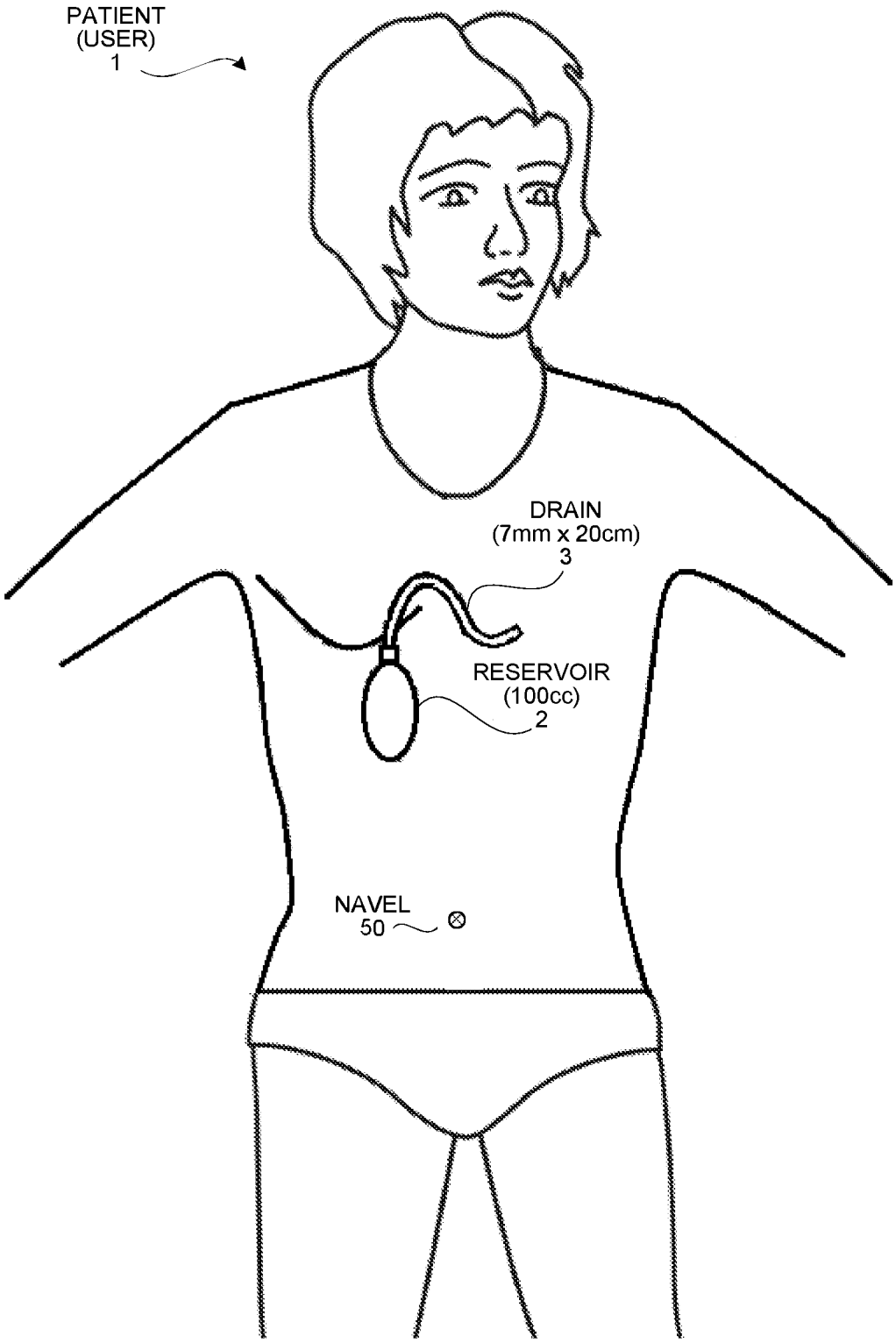
(PRIOR ART) FIG. 1
FIG. 1 is a perspective diagram of a patient 1 using a post-operative drain 3 after a surgical procedure according to prior art.
Figure 2:
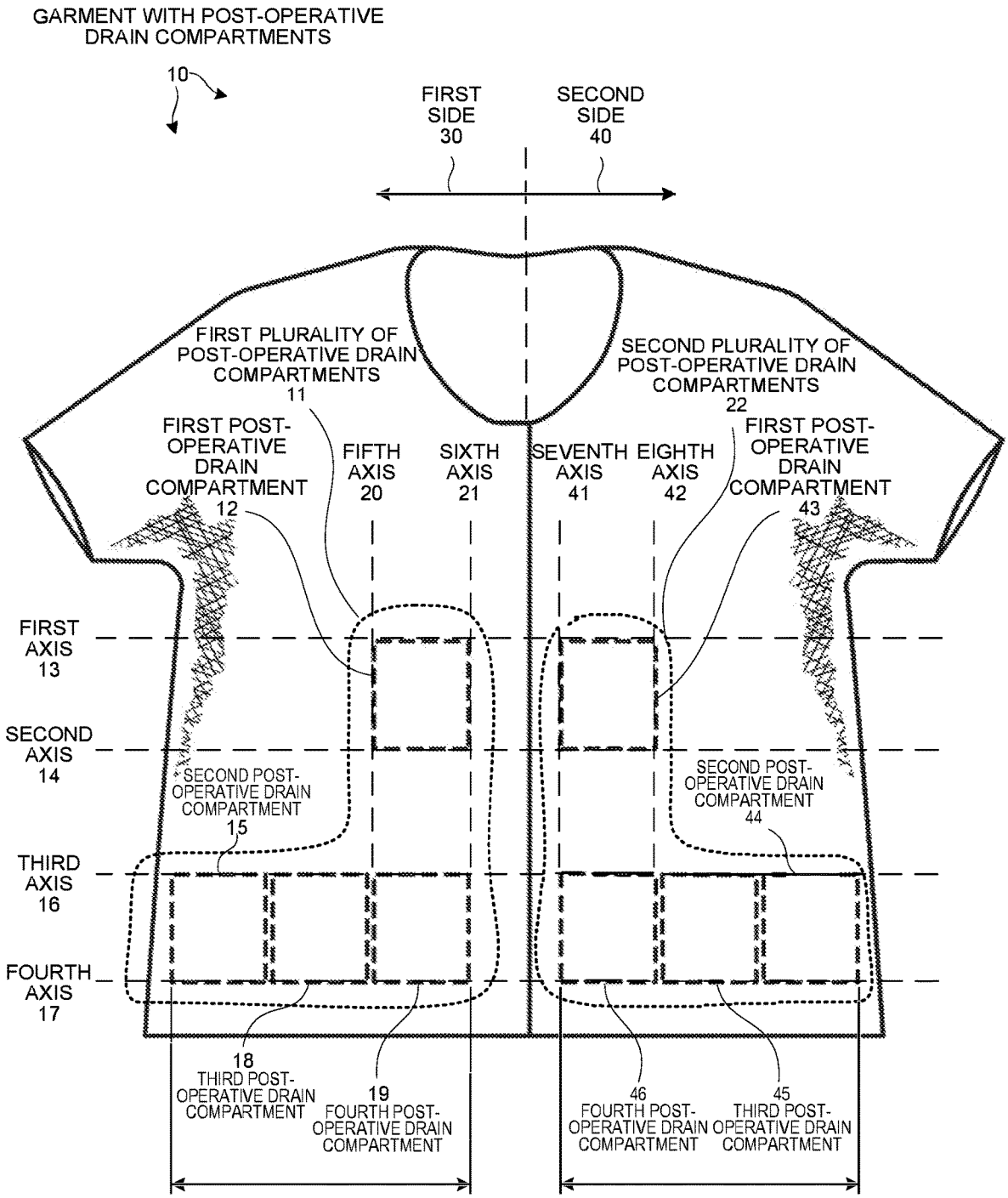
FIG. 2 is a diagram of a front perspective view of a garment with post-operative drain compartments.

FIG. 2 is a diagram of a front perspective view of a garment 10 with post-operative drain compartments. The garment 10 comprises a first side 30 and a second side 40. The first side 30 comprises a first plurality of post-operative drain compartments 11 and a second plurality of post-operative drain compartments 22. The first plurality of post-operative drain compartments 11 has a first post-operative drain compartment 12, a second post-operative drain compartment 15, a third post-operative drain compartment 18, and a fourth post-operative drain compartment 19. The second plurality of post-operative drain compartments 22 has a first post-operative drain compartment 43, a second post-operative drain compartment 44, a third post-operative drain compartment 45, and a fourth post-operative drain compartment 46.

In accordance with one novel aspect, the post-operative drain compartments are disposed along numerous axes described below. A first axis 13 is parallel to and above a second axis 14. The second axis 14 is parallel to and above a third axis 16. The third axis 16 is parallel to and above a fourth axis 17. On the first side 30, a fifth axis 20 is parallel to a sixth axis 21. On the second side 40, a seventh axis 41 is parallel to an eighth axis 42. The first, second, third, and fourth axes (13, 14, 16, 17) are perpendicular to the fifth, sixth, seventh, and eight axes (20, 21, 41, 42).

On the first side 30, the first post-operative drain compartment 12 is disposed horizontally between the first axis 13 and the second axis 14, and vertically between the fifth axis 20 and the sixth axis 21. The first post-operative drain compartment 12 is parallel to the fourth post-operative drain compartment 19. On the first side 30, the second, third, and fourth post-operative drain compartments (15, 18, 19) are disposed horizontally between the third axis 16 and the fourth axis 17. The fourth post-operative drain compartment 19 is disposed vertically between the fifth axis 20 and the sixth axis 21.

On the second side 40, the first post-operative drain compartment 43 is disposed horizontally between the first axis 13 and the second axis 14 and vertically between the seventh axis 41 and the eighth axis 42. The fourth post-operative drain compartment 46 is parallel to the first post-operative drain compartment 43. On the second side 40, the second, third, and fourth post-operative drain compartments (44, 45, 46) are disposed horizontally between the third axis 16 and the fourth axis 17. The fourth post-operative drain compartment 46 is disposed vertically between the seventh axis 41 and the eighth axis 42. By orienting the post-operative drain compartments in this way, the user of the garment is given significant versatility in securing post-operative drains.

Figure 3:
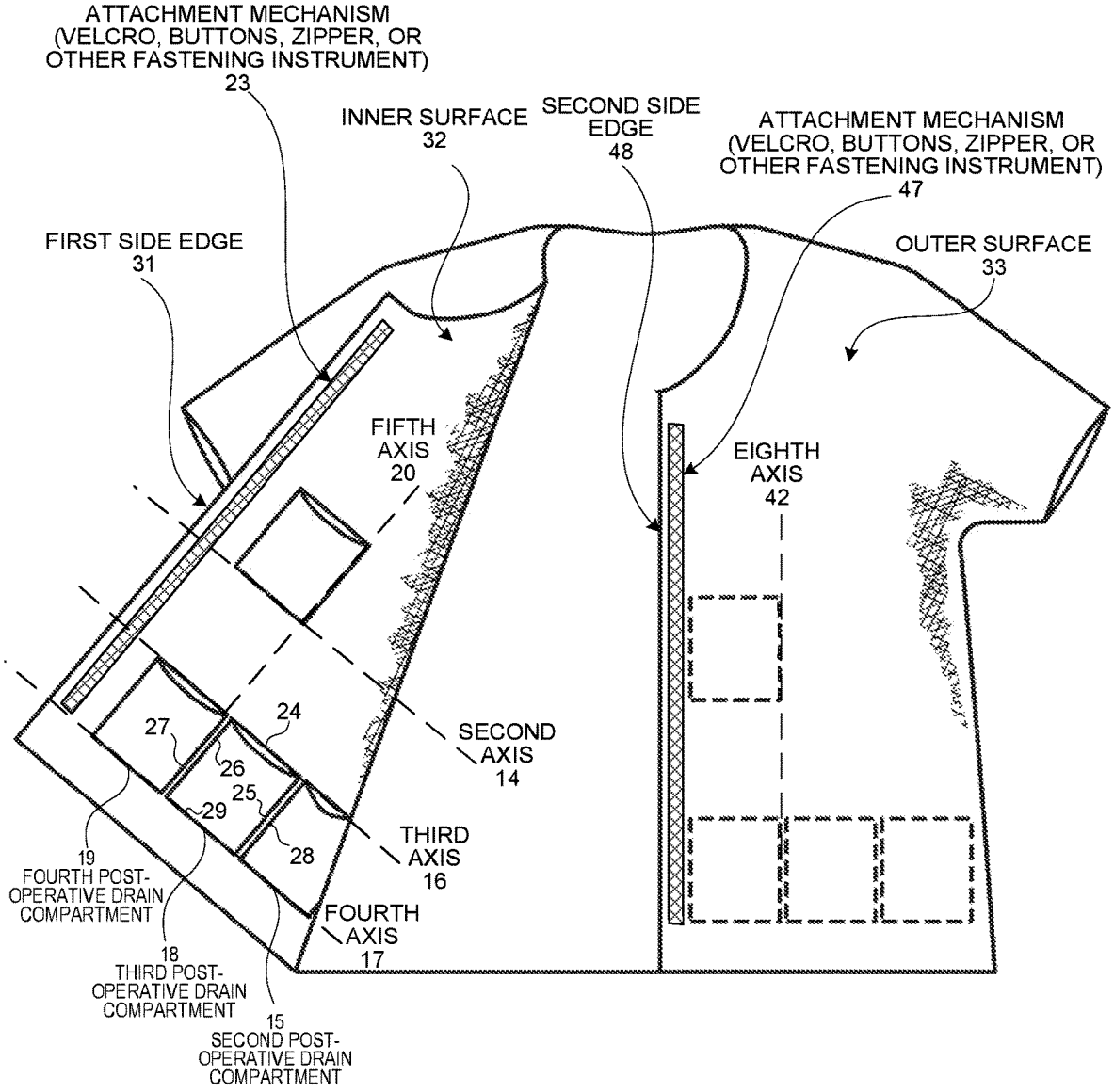
FIG. 3 is a diagram showing an inner surface of the garment having the post-operative drain compartments.

FIG. 3 is a diagram showing an inner surface 32 of the garment 10 having the post-operative drain compartments. In this example, the third post-operative drain compartment 18 has four edges. A first edge 24 is disposed along the third axis 16. A second edge 25 is disposed along a fourth edge of the second post-operative drain compartment 28. A third edge 29 is disposed along the fourth axis 17. The fourth edge 26 is disposed along a second edge of the fourth post-operative drain compartment 27. In one example, the garment 10 is manufactured using natural fibers. In another example, the garment 10 is manufactured using synthetic fibers. In yet another example, the garment 10 is manufactured using a combination of natural fibers and synthetic fibers. In one example, the garment 10 comprises a material selected from the group consisting of: cotton, flax, wool, ramie, silk, denim, leather, down, fur, nylon, and polyester.

On an inner surface 32 of the first side 30, an attachment mechanism 23, for example, Velcro, buttons, zipper, or other fastening instrument, is along a first side edge 31 and parallel to the fifth axis 20. On the outer surface 33 of the second side 40, another attachment mechanism 47 that complements the attachment mechanism 23, for example, Velcro, buttons, zipper, or other fastening instrument, is along a second side edge 48 and parallel to the eighth axis 42.

Figure 4:
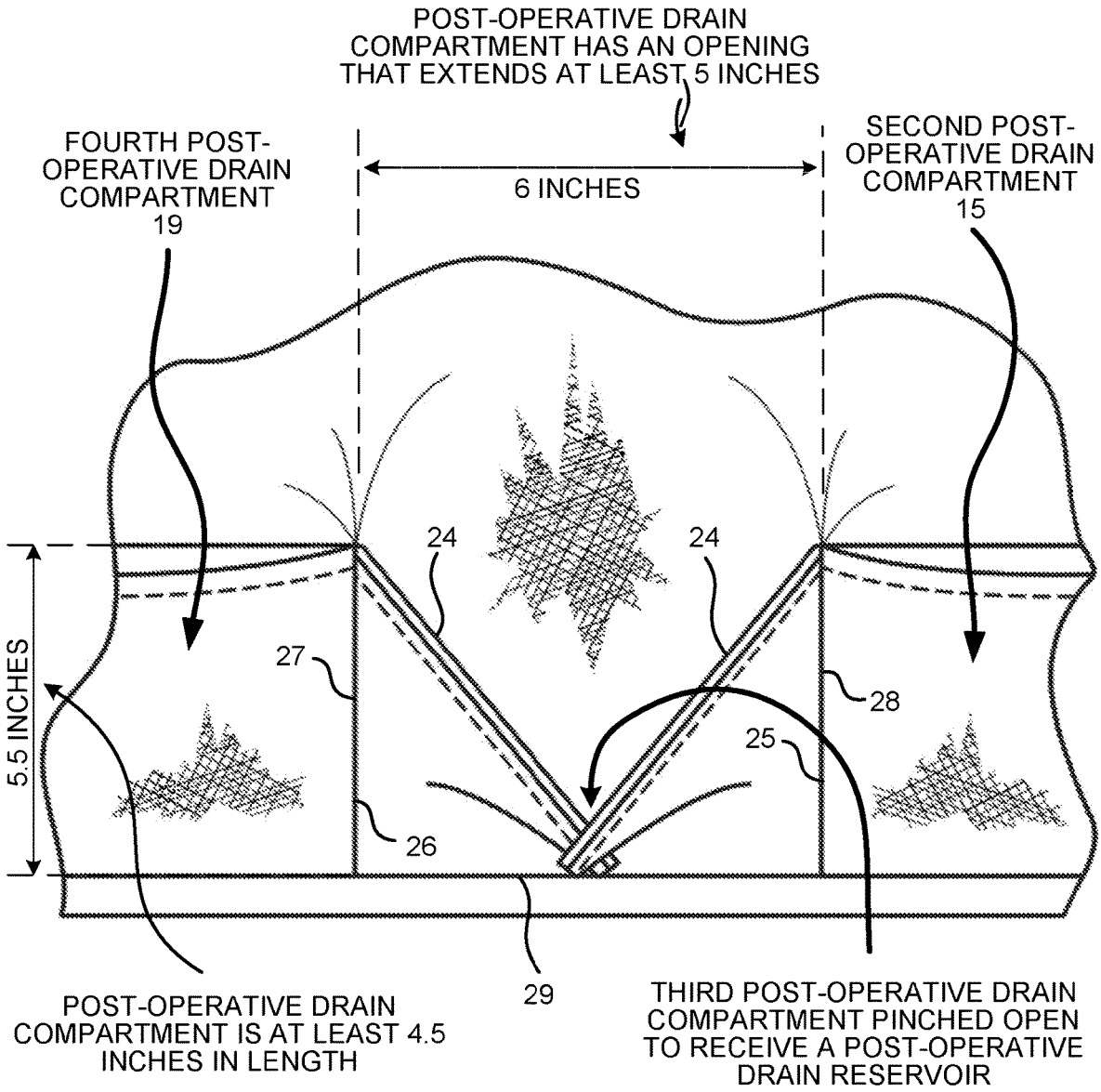
FIG. 4 is a diagram showing how one of the post-operative drain compartments is pinched open to receive a post-operative drain reservoir.

FIG. 4 is a diagram showing how one of the post-operative drain compartments is pinched open to receive a post-operative drain reservoir. The first edge (or upper extent) of each of the plurality of the post-operative drain compartments has an opening that extends at least 5 inches. The second and fourth edges (or the side edges) of each of the plurality of the post-operative drain compartments extend at least 4.5 inches. These dimensions provide optimal retaining volume for reservoirs of typical post-operative drains. In this example, the first edge extends approximately 6.0 inches, and the side edges extend approximately 5.5 inches.

In this example, each of the bottom and side edges of the post-operative drain compartment is stitched into the inner surface 32 of the garment 10. In another example, the post-operative drain compartments are glued onto the inner surface 32 of the garment 10. In another example, the post-operative drain compartments are attached to the inner surface 32 of the garment 10 using another attachment mechanism such as a safety pin, magnet, buttons, zippers, Velcro, or a combination of the above.

In accordance with another novel aspect, the upper edge of each post-operative drain compartment remains open thereby providing easy and quick storage of the post-operative drains. In the example of FIG. 4, the first edge of the third post-operative drain compartment 24 is shown pinched open to receive a post-operative drain. In one example, none of the post-operative drains has a closure mechanism or fastening mechanism that securely shuts the opening provided by the first edge (or upper edge). In the example of FIG. 4, the post-operative drains do not have any zipper, button, Velcro, or similar fastening mechanism and always remain open to provide ease of access. In another example, the post-operative drains have a closure mechanism or fastening mechanism that securely shuts the opening provided by the first edge (or upper edge), such as a zipper, button, Velcro, or similar fastening mechanism.

Figure 5:
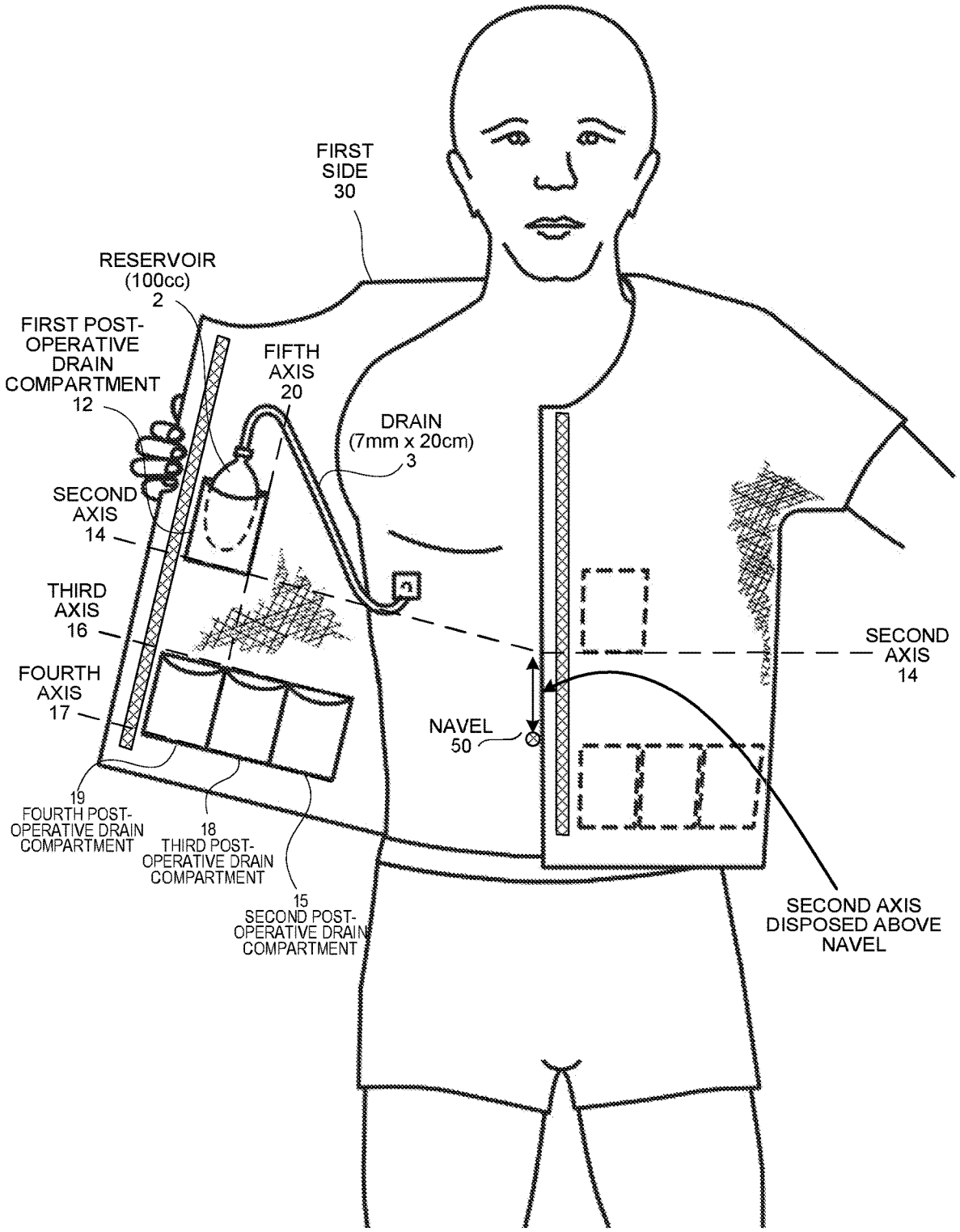
FIG. 5 is a diagram of a front perspective view of opening of a garment having post-operative drain compartments when worn by user.

FIG. 5 is a diagram of a front perspective view of opening of a garment having post-operative drain compartments when worn by user. The second axis 14 is disposed above the navel 50. At least one post-operative drain compartment is disposed above the navel 50 when worn by the user and the at least one post-operative drain compartment is also disposed above another post-operative drain compartment that is disposed below the navel 50. In this example, the first post-operative drain compartment 12 is in use. In another example, other post-operative drain compartments may be used to support post-operative drains.

Figure 6:
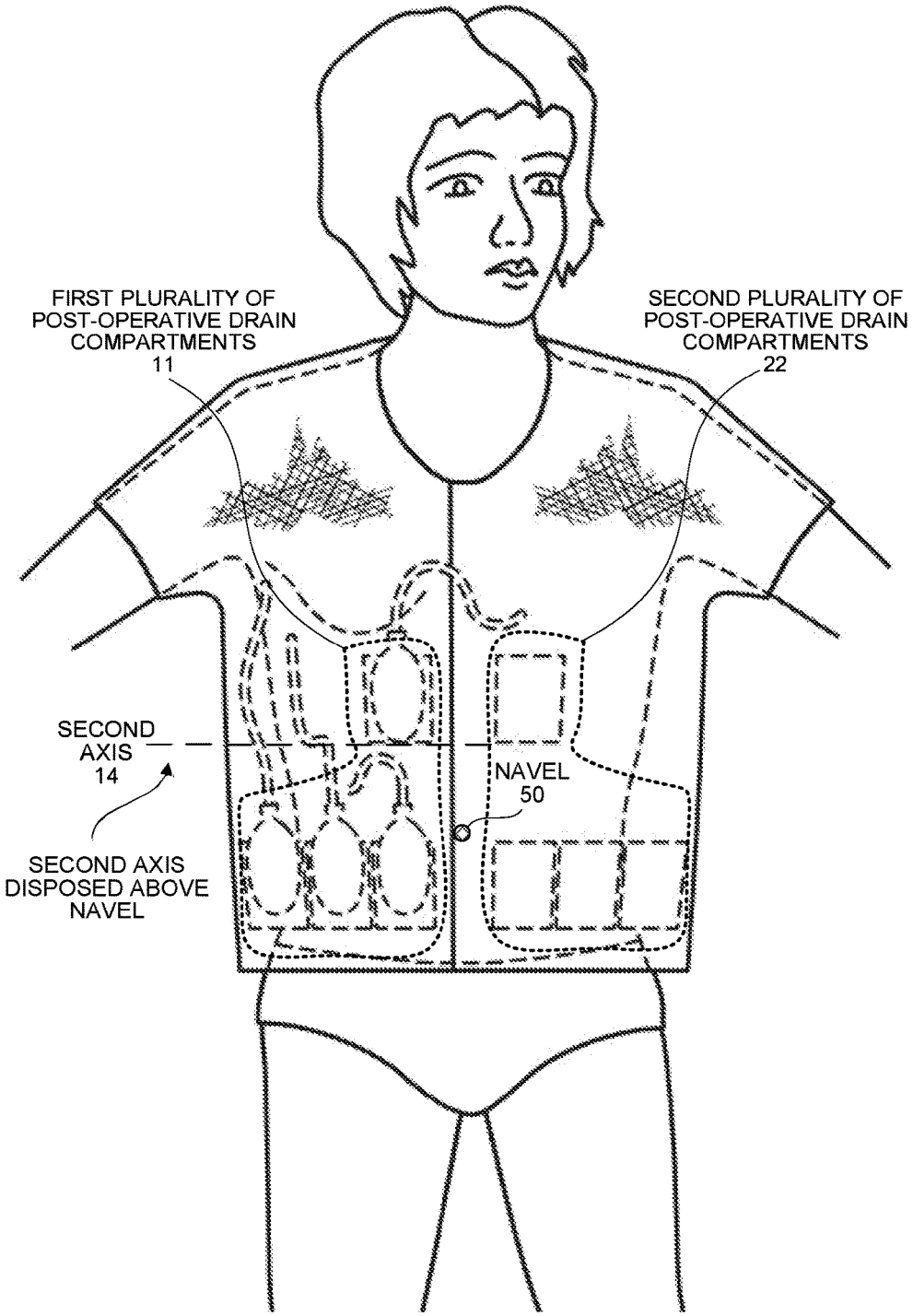
FIG. 6 is a diagram of a front perspective view of a garment having post-operative drain compartments when worn by user.

FIG. 6 is a diagram of a front perspective view of a garment having post-operative drain compartments when worn by user. The second axis 14 is disposed above the navel 50. In this example, each post-operative drain compartment in the first plurality 11 is in use. In another example, the second plurality of post-operative drain compartments 22 may be in use.

Figure 7:
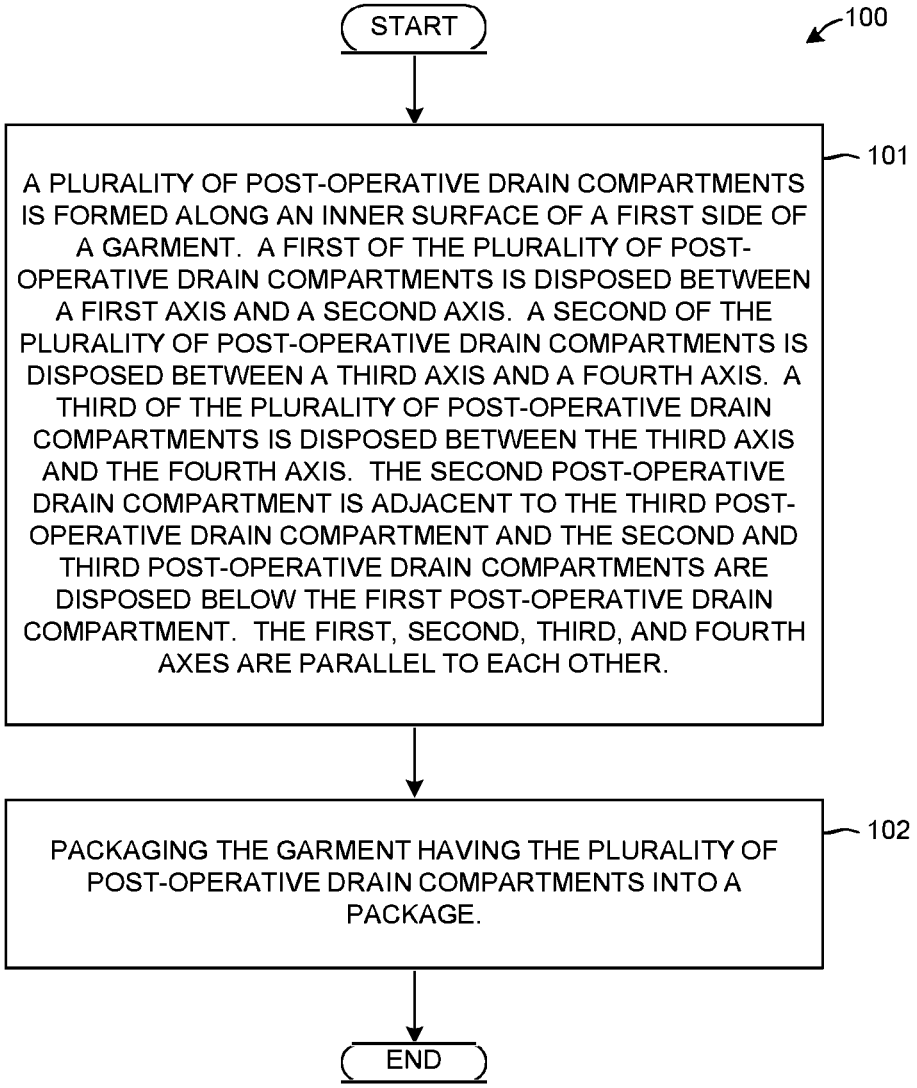
FIG. 7 is a flowchart of a method in accordance with one novel aspect.

FIG. 7 is a flowchart of a method 100 in accordance with one novel aspect. In a first step (step 101), a plurality of post-operative drain compartments is formed along an inner surface 32 of a first side of a garment. A first of the plurality of post-operative drain compartments is disposed between a first axis and a second axis. A second of the plurality of post-operative drain compartments is disposed between a third axis and a fourth axis. A third of the plurality of post-operative drain compartments is disposed between the third axis and the fourth axis. The second post-operative drain compartment is adjacent to the third post-operative drain compartment and the second and third post-operative drain compartments are disposed below the first post-operative drain compartment. The first, second, third, and fourth axes are parallel to each other. For example, in FIG. 2, the garment 10 has a first plurality of post-operative drain compartments 11 formed along the inner surface 32 of the first side 30. There are a first, second, third, and fourth post-operative drain compartments (12, 15, 18, 19) on the first side 30. In the example of FIG. 5, a reservoir (100 cc) 2 occupying the first post-operative drain compartment 12. The reservoir 2 is connected to a drain (7 mm×20 cm) 3. In another example, there may be a reservoir of a post-operative drain occupying each post-operative drain compartment. In second step (step 102), the garment with post-operative drain compartments is packed using packaging material.

Figure 8:
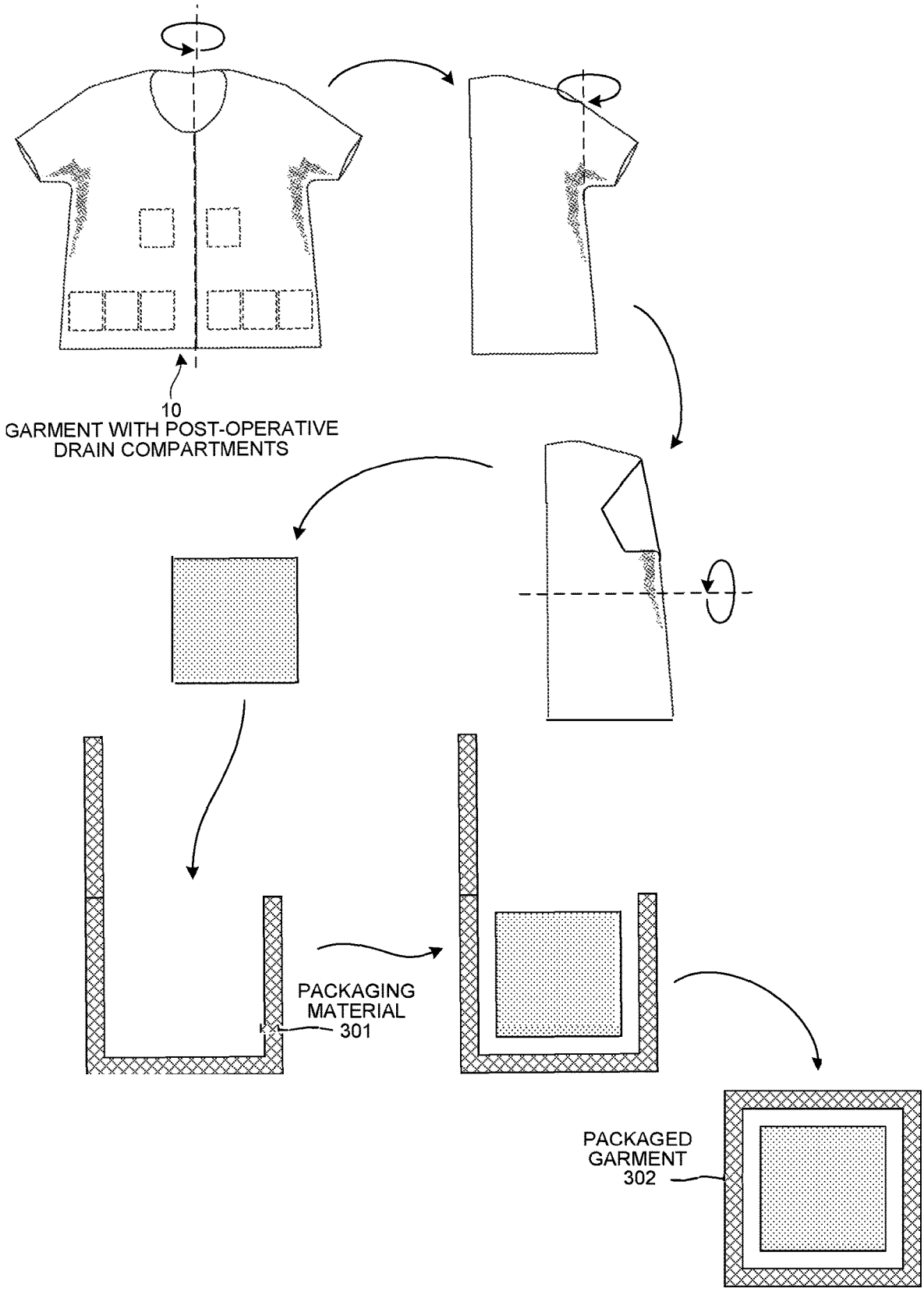
FIG. 8 is a diagram showing how to package a garment having post-operative drain compartments.

FIG. 8 is a diagram showing how to package a garment having post-operative drain compartments. In the example in FIG. 8, the garment 10 is folded compactly and packaged into the packaging material 301. The packaged garment 302 is then distributed to medical retailers or other sales distribution channels.

Figure 9:
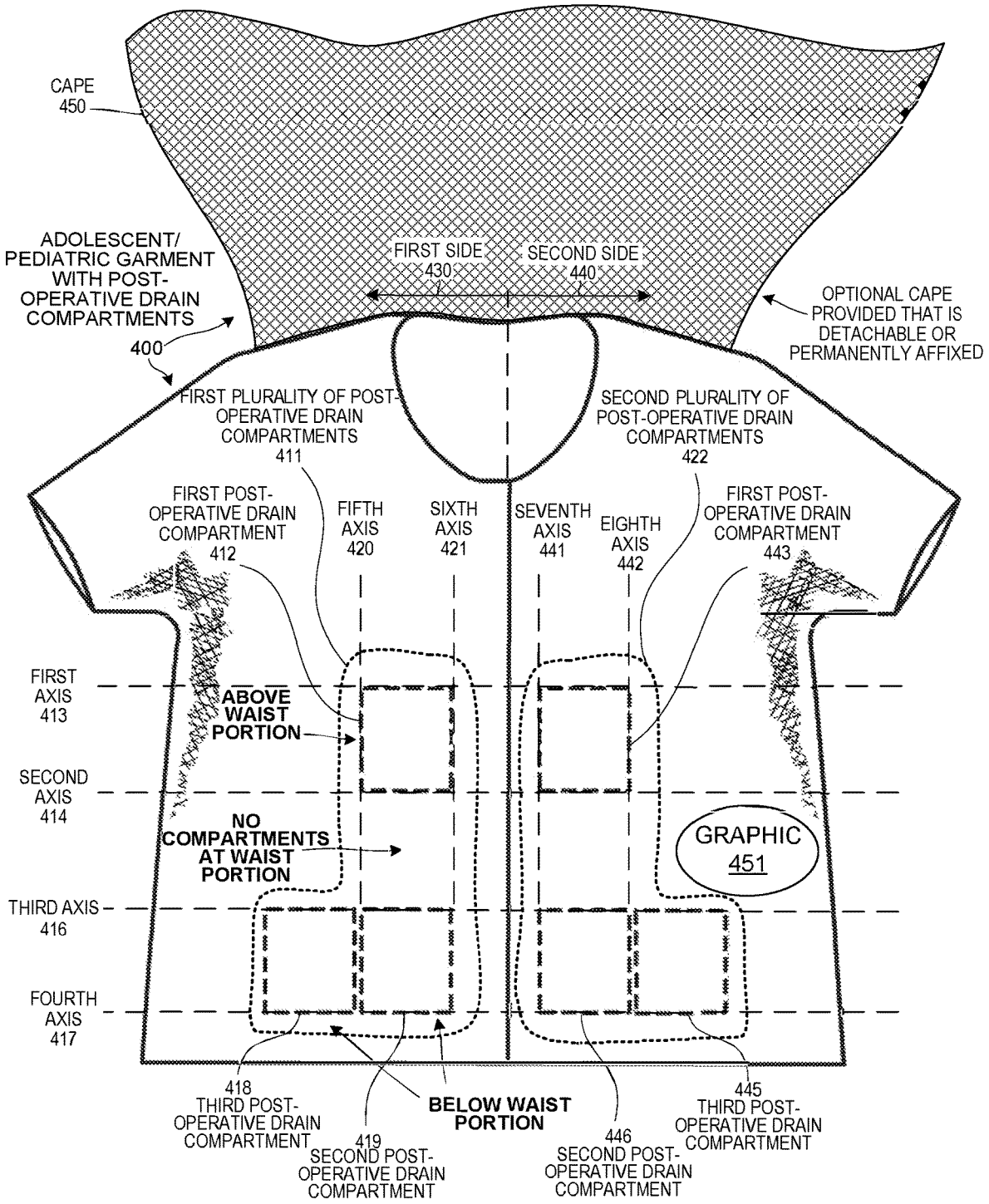
FIG. 9 is a diagram of a garment 400 having post-operative drain compartments for pediatric patients.

FIG. 9 is a diagram of a garment 400 having post-operative drain compartments for pediatric patients. The garment 400 is manufactured and provided to pediatric patients, including children and young adults. The garment 400 has at least one less compartment post-operative drain on each side than garment 10. The garment 400 has smaller dimensions than the garment 10 of FIG. 2. In one example, the garment 400 has drain compartments that are one-inch smaller in at least one-dimension as compared to drain compartments of garment 10. In another example, the garment 400 has drain compartments that are the same dimensions as compared to drain compartments of garment 10.

The garment 400 comprises a first side 430 and a second side 440. The first side 430 comprises a first plurality of post-operative drain compartments 411 and a second plurality of post-operative drain compartments 422. The first plurality of post-operative drain compartments 411 has a first post-operative drain compartment 412, a second post-operative drain compartment 419, and a third post-operative drain compartment 418. The second plurality of post-operative drain compartments 422 has a first post-operative drain compartment 443, a second post-operative drain compartment 446, and a third post-operative drain compartment 445.

In accordance with one novel aspect, the post-operative drain compartments are disposed along numerous axes described below. A first axis 413 is parallel to and above a second axis 414. The second axis 414 is parallel to and above a third axis 416. The third axis 416 is parallel to and above a fourth axis 417. On the first side 430, a fifth axis 420 is parallel to a sixth axis 421. On the second side 440, a seventh axis 441 is parallel to an eighth axis 442. The first, second, third, and fourth axes (413, 414, 416, 417) are perpendicular to the fifth, sixth, seventh, and eight axes (420, 421, 441, 442).

On the first side 430, the first post-operative drain compartment 412 is disposed horizontally between the first axis 413 and the second axis 414, and vertically between the fifth axis 420 and the sixth axis 421. The first post-operative drain compartment 412 is parallel to the second post-operative drain compartment 419. On the first side 430, the second and third post-operative drain compartments (418 and 419) are disposed horizontally between the third axis 416 and the fourth axis 417. The second post-operative drain compartment 19 is disposed vertically between the fifth axis 420 and the sixth axis 421. Although the second post-operative drain compartment 419 is shown disposed directly below the first post-operative drain compartment 412, in other embodiments the second post-operative drain compartment 419 is offset to the left or right and not directly below the first post-operative drain compartment 412.

On the second side 440, the first post-operative drain compartment 443 is disposed horizontally between the first axis 413 and the second axis 414 and vertically between the seventh axis 441 and the eighth axis 442. The second post-operative drain compartment 446 is parallel to the first post-operative drain compartment 443. On the second side 440, the second and third (445 and 446) are disposed horizontally between the third axis 416 and the fourth axis 417. The second post-operative drain compartment 446 is disposed vertically between the seventh axis 441 and the eighth axis 442. By orienting the post-operative drain compartments in this way, the user of the garment is given significant versatility in securing post-operative drains. Although the second post-operative drain compartment 446 is shown disposed directly below the first post-operative drain compartment 443, in other embodiments the second post-operative drain compartment 446 is offset to the left or right and not directly below the first post-operative drain compartment 443.

In accordance with another novel aspect, an amount of fabric 450 is attached to the garment 400 and extends away from the garment. In one example, the amount of fabric 450 is a cape. The cape 450 is permanently affixed to the garment 400 or is detachable via Velcro, buttons, clips, or other types of mechanical fastening mechanisms. The cape 450 adds significant appeal to adolescent or pediatric users. The cape 450 is provided to mimic that of a superhero or action hero. In other embodiments, the garment 400 is provided without any cape 450.

In accordance with yet another novel aspect, one or more textual or graphical elements 451 are affixed to an outer portion of the garment. The textual or graphical elements 451 add additional appeal to children and adolescent users of garment 400. The textual or graphical elements 451 may include cultural figures or references, known icons, slogans, trademarks or trade names, artistic designs, or similar text or graphical elements. In other embodiments, the garment 400 is provided without any added textual or graphical elements 451.

Although certain specific exemplary embodiments are described above in order to illustrate the invention, the invention is not limited to the specific embodiments. For example, although the garment is shown as a t-shirt, in other embodiments, the garment may be a long sleeve shirt, a pajama, a vest, a zip, a coat, and a jacket.

The example of FIG. 2 has a set of compartments on each side, however, in other embodiments, the compartments are all disposed along a single side. Although the compartments of FIG. 2 have one compartment above three lower compartments, in another example, the compartments have two upper compartments that are aligned between first and second axes 13,14 and two lower compartments that are aligned between the third and fourth axes 16,17. In yet another example, there are compartments situated vertically between two other compartments. For example, one compartment is disposed above a second compartment, which in turn, is disposed above a third compartment. The first, second and third compartments are stacked vertically.

In another embodiment, the compartments are disposed along a grid pattern such that a compartment is selectively disposed at along elements of the grid pattern. The grid has dimensions A×B taken from group consisting of: 1×1, 1×2, 1×3, 1×4, 2×1, 2×2, 2×3, 3×4, 3×1, 3×2, 3×3, 3×4, and 4×1, 4×2, 4×3, and 4×4. The dimension "A" represents the number of compartments horizontally along the grid (for example, parallel to the first axis 13) and the dimension "B" represents the number of compartments vertically along the grid (for example, parallel to the fifth axis 20). One or more of grids may selectively not have any compartment to provide a gap between the compartments.

Figure 10:
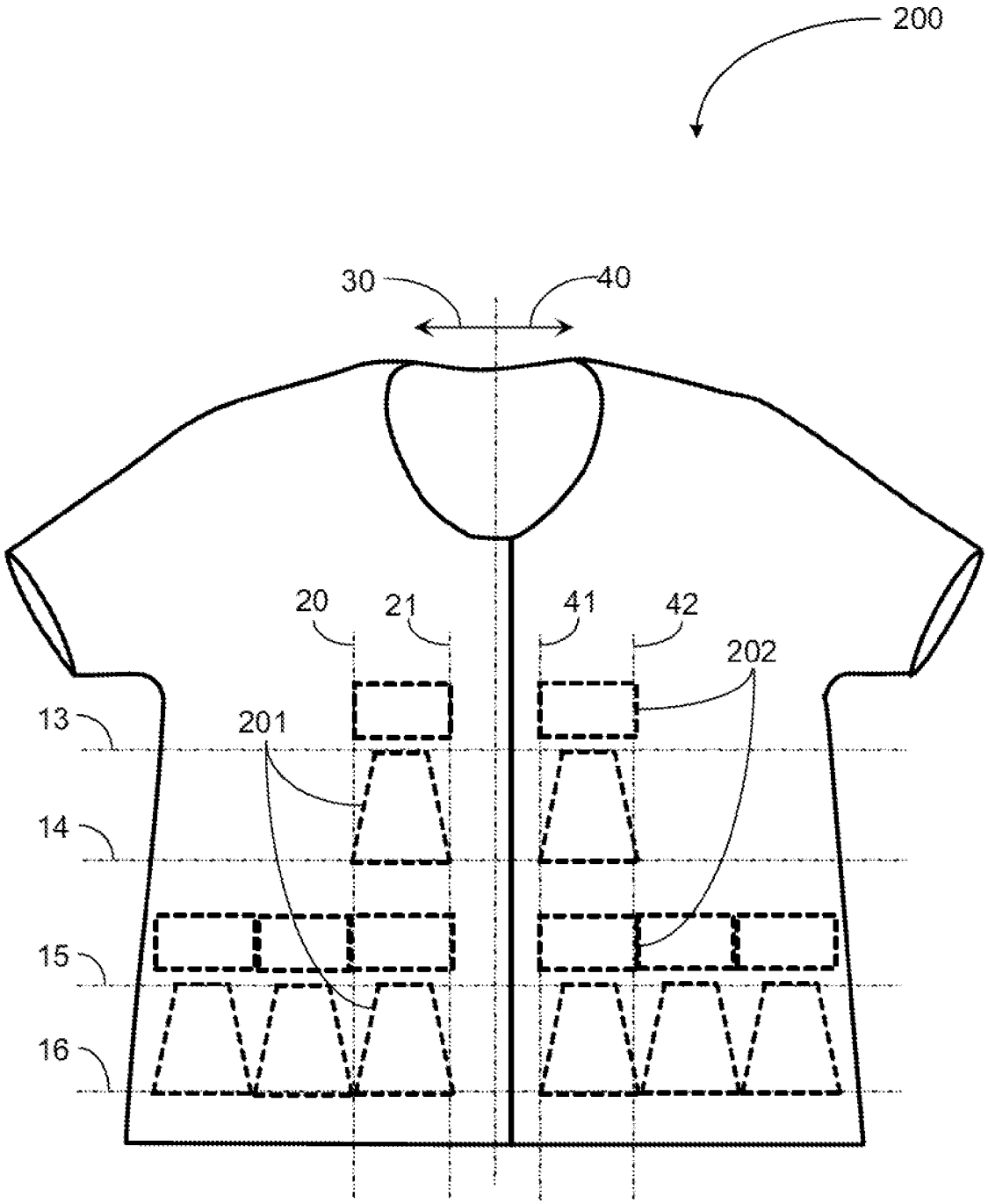
FIG. 10 is a front elevation view of a garment with post-operative drain compartments according to another embodiment of the invention.

Trapezoidal Compartment Profile with Tube Retention Utility:

FIG. 10 is a front elevation view of a garment 200 with post-operative drain compartments according to another embodiment of the invention. Garment 200 may be analogous in materials, construction, number of drain compartments, and spatial orientation of those drain compartments to garment 10 described relative to FIG. 2 further above.

In this embodiment, drain pockets 201 are strategically spatially arranged within the guidelines of vertical axis' 20 and 21 on garment side 30, and 41 and 42 on garment side 40 and within the guidelines of horizontal axis' 13, 14, 15, and 16. Garment 200 may have the same total number of drain pockets as garment 10 introduced in FIG. 2. However, in this embodiment, an improvement in the profile shape of the drain compartment 201 is provided as a utility for retaining drain bulbs more securely within the compartment.

Drain compartments 201 are provided in a trapezoidal form having a closed bottom and an open top. In a preferred embodiment, the bottom width of drain compartment 201 is similar to or the same as the width of the rectangular drain compartments of garment 10. In this embodiment, the height of drain compartments 201 may be similar to or the same as the height of the rectangular drain compartments of garment 10. The trapezoidal configuration of drain compartments 201 provides for a smaller width at the top opening of the drain compartment. The smaller opening may be just wider than the outside diameter of a stock drain bulb (reservoir) like drain reservoir 2 introduced in the description of FIG. 5 further above, which has a full volume of about 100 cubic centimeters (cc).

The smaller opening of drain compartments 201 retain the drain bulb in a vertical position for insertion. The width dimension of the opening of the drain compartment is larger than the outside diameter of the drain bulb full so that it may also be retrieved from the trapezoidal drain compartment 201 in vertical position. The wide bottom of drain compartments 201 enable a user to rotate the stock bulb 90 degrees to horizontal once it is fully inserted into the drain compartment. This utility (trapezoidal form) reduces the chance of the drain bulb being accidentally pulled out of drain compartment 201.

In this embodiment, garment 200 includes multiple drain tube retention straps 202, also referred to as tube keeper panels. In this example, drain tube retention straps number the same as drain compartments 201 with the retainer straps positioned above each of the drain compartments aligning vertical centers. Tube retention straps 202 are adapted as tubing retainers or keepers for the drain tubes connected to the stock drain bulbs. Tube retention strap 202 holds tubing close to the garment material preventing drift and potential snags as well as isolating the tubes from the patient's skin.

Tube retention strap 202 is sewn into or otherwise attached to garment 200 vertically along the shorter edges of the strap leaving the strap open at the top and open at the bottom. Retainer strap 202 is rectangular in this example, and has a horizontal width dimension roughly the same as the width dimension of the bottom of drain compartment 201. Tube retention straps 202 have a sufficiently tall footprint for effectively retaining stock drain tubes vertical underneath the strap while the connected drain bulbs are positioned inside drain compartments 201. Drain compartments 201 and tube retention straps 202 may be fabricated from elastic materials that are resilient but stretch out to enable tucking of the stock drain bulb and tubing under the retention strap and into the drain compartment where the bulb is rotated horizontally, and the extra tubing length is tucked into the drain compartment on top of the drain bulb.

In a preferred embodiment, there is room to tuck extra length tubing into drain compartment 201 as described above. The inward facing angles of the vertical sides of drain compartments 201 culminate into a smaller width dimension for the top opening aiding to keep extra tubing tucked into the drain compartment on top of the horizontal drain bulb discouraging upward drift of the tubing inserted into the drain compartment. In one embodiment, the material used to fabricate drain compartment 201 and retention strap 202 is waterproofed with a material lining or is fabricated from waterproof elastic material such as a synthetic rubber-based composite like polyurethane.

Figure 11B:
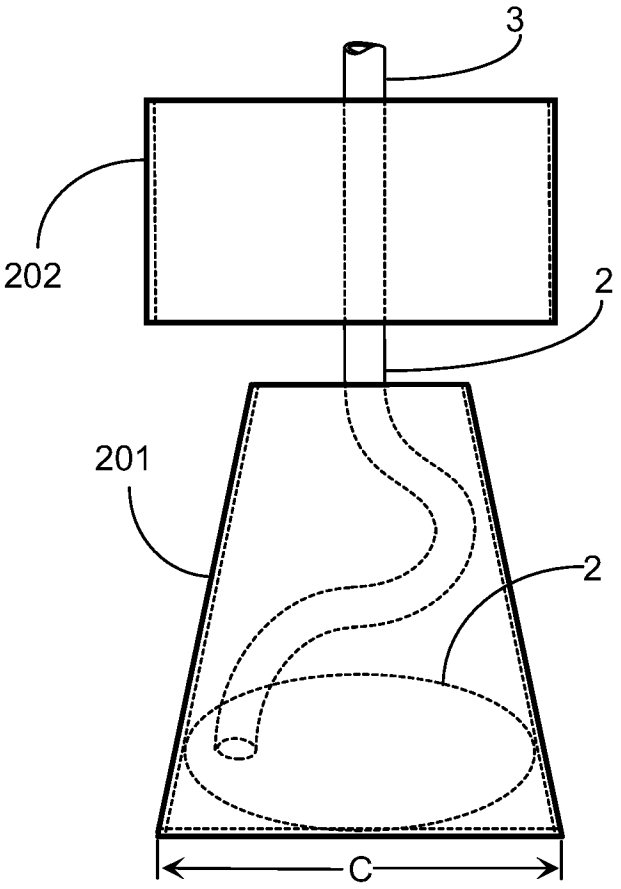
FIG. 11A is a front elevation view of a drain bulb and drain tube being inserted vertically into the drain compartment through the tube retention strap.
FIG. 11 B is a front elevation view of the drain bulb of FIG. 10A rotated horizontally in the drain compartment.
Figure 11A:
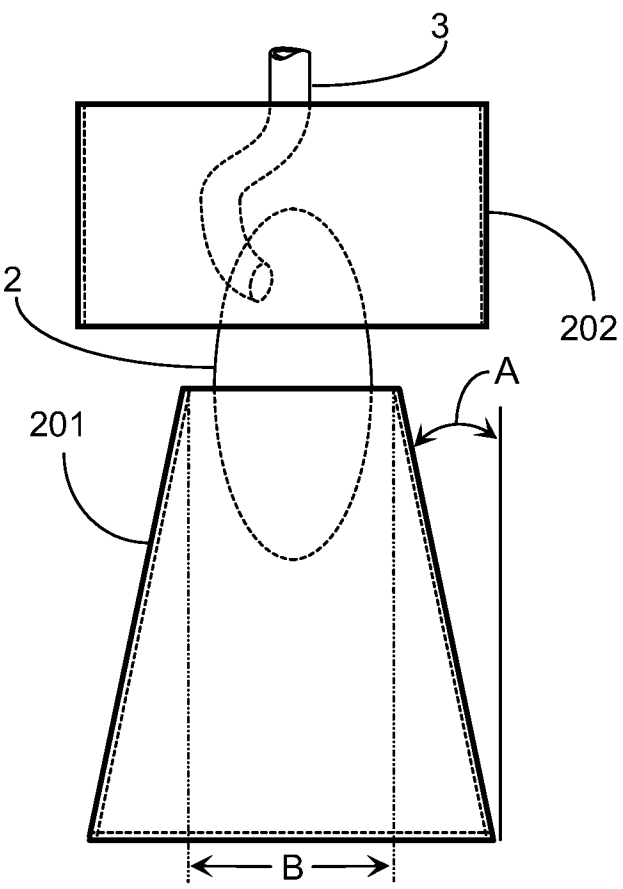

FIG. 11A is a front elevation view of a drain bulb and drain tube being inserted vertically into the drain compartment through the tube retention strap. In this embodiment, drain compartment 201 has a trapezoidal shape resulting in an angle A of about 10 degrees inward from vertical. The top opening of drain compartment 201 has an inside width dimension B that exceeds the full outside diameter of drain bulb 2.

In a preferred embodiment, drain bulb 2 connected to drain tube 3 is inserted into drain compartment 201 underneath tube retention strap 202. The elasticity of strap 202 enables the user to pull the strap out to accommodate the diameter of the drain bulb 2 and the connected tube 3. In one embodiment, drain bulb 2 connects to drain tubing 3 at one end of the bulb. In this example, the connection is proximal to one end of the bulb.

FIG. 11 B is a front elevation view of the drain bulb of FIG. 10A rotated horizontally in the drain compartment. In this embodiment, drain bulb 2 is depicted fully inserted into drain compartment 201 and rotated fully on its side and resides in a horizontal position while the drain bulb is used. In this embodiment, extra tubing length of tube 3 is tucked into drain compartment 201 on top of bulb 2. Drain tube 3 is retained behind tube retention strap 202 in a relative vertical, straight position. The bottom of drain compartment 201 has a width C that is wide enough to accommodate the full length of drain bulb 2 comfortably so that it may be easily manipulated from horizontal back to vertical after it is full or otherwise after use.

Figure 12:
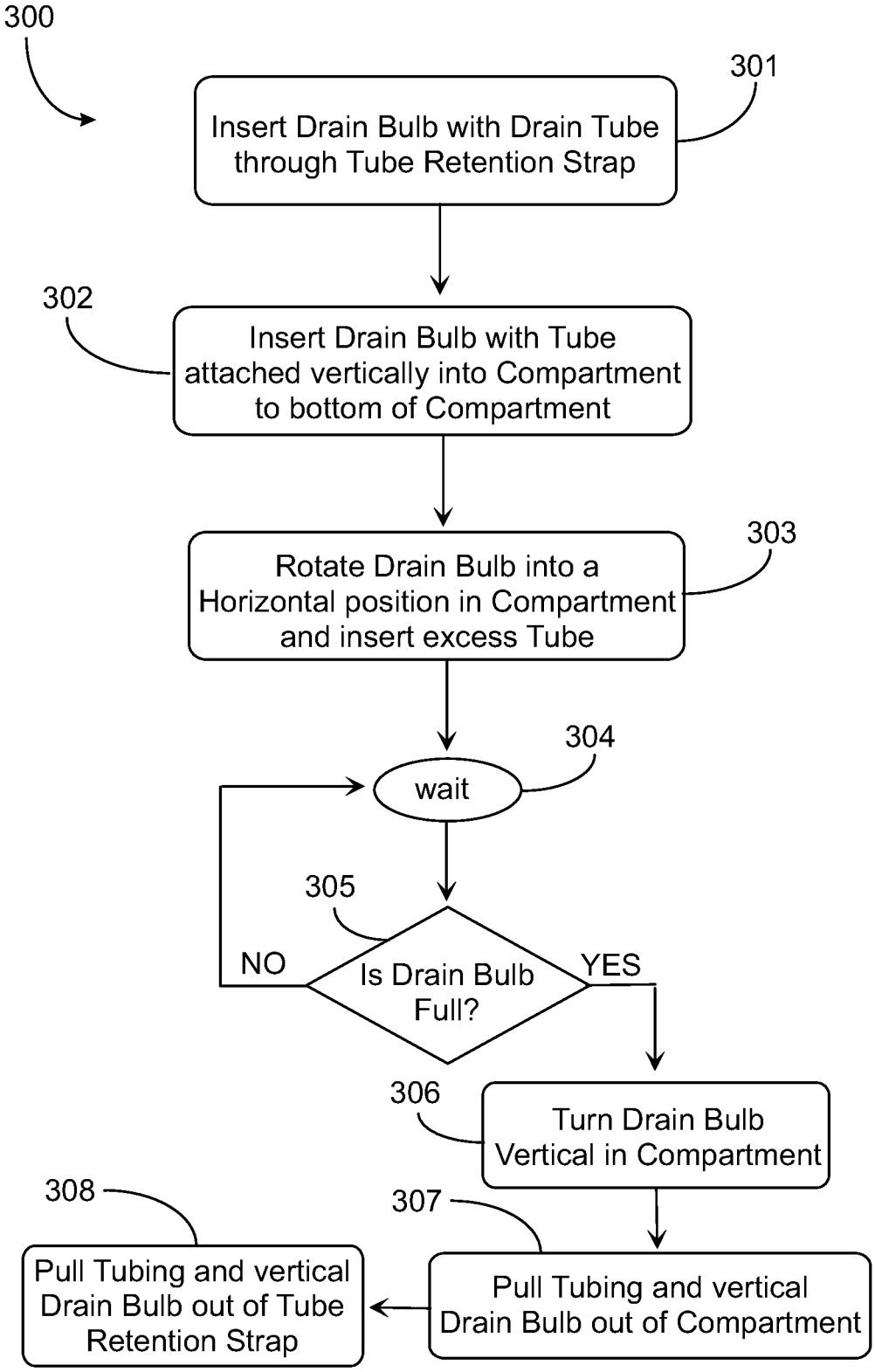
FIG. 12 is a process flow chart depicting steps for securing an empty drain bulb and tube into a compartment, and removing the bulb after use according to a unique aspect of the invention.

FIG. 12 is a process flow chart 300 depicting steps for securing an empty drain bulb and tube into a compartment, and removing the bulb after use according to a unique aspect of the invention. At step 301, a user may insert an unexpanded drain bulb connected to a drain tube through the tube retention strap above the targeted drain compartment. At step 302, the user may insert the drain bulb connected to the drain tube vertically into drain compartment 201. In this step the user urges the drain bulb all the way down into the compartment.

At step 303, the user may rotate the drain bulb to a horizontal position at the bottom of the drain tube compartment. In this step the user may also tuck in any access tubing length into the drain compartment on top of the drain bulb. In this position, the drain tube may be used and will fill with fluids and expand accordingly. At step 304, the user may wait until it is time to remove the drain bulb from the drain compartment.

At step 305, a user may determine if the drain bulb is full or otherwise needs to be removed. If at step 305 it is determined that the drain bulb should remain in use, the process may loop back to step 304. At step 305, if the user determines that the drain bulb is full or otherwise it is time to remove the drain bulb, then at step 306, the user may rotate the drain bulb back to vertical working within the drain compartment. At step 307, the user may pull the excess tubing and drain bulb out of the drain compartment in vertical position. At step 308, the user may pull the tubing and connected drain bulb out of the retention strap.

The process helps to prevent tubing from more than one wound from crossing, making contact with skin, snagging, or otherwise tangling. Multiple drain bulbs may be used with the garment wherein each drainage system is isolated from the other system or systems. Accordingly, various modifications, adaptations, and combinations of various features of the described embodiments can be practiced without departing from the scope of the invention.

It will be apparent with skill in the art that the post-surgical garment of the present invention may be provided using some or all the elements described herein. The arrangement of elements and functionality thereof relative to the post-surgical garment of the invention is described in different embodiments each of which is an implementation of the present invention. While the uses and methods are described in enabling detail herein, it is to be noted that many alterations could be made in the details of the construction and the arrangement of the elements without departing from the spirit and scope of this invention. The present invention is limited only by the breadth of the claims below.

The invention claimed is:

1. A garment comprising:

an inner side and an outer side and a fastening mechanism to fasten the garment while worn;

a number of trapezoidal drain compartments spatially arranged and attached on the inner side of the garment, each trapezoidal drain compartment having a top opening sized to accept a stock drain bulb vertically therein and a closed bottom wide enough to accommodate the drain bulb rotated to a horizontal position therein;

a same number of tube retention straps spatially arranged and attached on the inner side of the garment, each retention strap having a top opening and a bottom opening of a same size roughly equal to the width of the closed bottom side of the trapezoidal drain compartments, each retention strap vertically centered over, spaced above, and attached to the garment at a uniform distance above a trapezoidal drain compartment attached to the garment.

2. The garment of claim 1, configured to be worn about the torso.

3. The garment of claim 1, wherein the drain compartments and tube retention straps are sewn into a fabric of the garment.

4. The garment of claim 1, wherein the opening of the drain compartment is larger than the outside diameter of a full drain bulb and significantly smaller than the length of the drain bulb.

5. The garment of claim 1, wherein the trapezoidal drain compartments and the tube retention straps are fabricated from a polyurethane material having elastic and waterproof characteristics.

6. The garment of claim 1, wherein the angular offset of the trapezoidal form from rectangular form is 10 degrees inward from vertical for each side of the trapezoid.

7. The garment of claim 1, having eight trapezoidal drain compartment and retention strap configurations arranged symmetrically at four configurations per side of the garment.

8. The garment of claim 7, wherein the individual trapezoidal drain compartment and retention strap configurations are disposed over the inner surface of the garment according to a set of vertical and horizontal axis'.

* * * * *